US005822804A

United States Patent [19]

Hauflaire

[11] Patent Number: 5,822,804

[45] Date of Patent: Oct. 20, 1998

[54] PORTABLE MALE TODDLER URINAL

[76] Inventor: Marcia Hauflaire, 26 N. Woodland Trail, Palos Park, Ill. 60464

[21] Appl. No.: 785,060

[22] Filed: Jan. 17, 1997

[51] Int. Cl.[6] ..... E03D 13/00

[52] U.S. Cl. ..... 4/144.1; 4/301; 4/378; 4/902

[58] Field of Search ..... 4/144.1, 301, 310, 4/311, 479, 480, 481, 378, 902, 569

[56] References Cited

U.S. PATENT DOCUMENTS

| | | | |
|---|---|---|---|
| 1,227,399 | 5/1917 | De Wendt | 4/144.1 |
| 2,147,588 | 3/1939 | Zinkil et al. | 4/310 |
| 2,769,982 | 11/1956 | Gossett | 4/144.1 |
| 3,964,110 | 6/1976 | Kapit | 4/311 |
| 5,388,279 | 2/1995 | Rasmussen | 4/144.1 |

FOREIGN PATENT DOCUMENTS

| | | | |
|---|---|---|---|
| 3347977 | 1/1986 | Germany | 4/144.1 |
| 518855 | 3/1940 | United Kingdom | 4/310 |
| 570825 | 4/1945 | United Kingdom | 4/311 |

*Primary Examiner*—Charles R. Eloshway

[57] ABSTRACT

A portable urinal for a male toddler. The urinal includes a frame structure including a removable flush tank and a flow control device for regulating the flow of water from said tank to flush the urinal after it has been used. The flow control device is regulated by a handle. In the lower part of the urinal below a front opening is located a drain plate including a drain opening through which the urine flows into a drawer which can be pulled out and cleaned.

5 Claims, 1 Drawing Sheet

PORTABLE MALE TODDLER URINAL

FIELD OF THE INVENTION

This invention relates to a portable urinal to be used for the utilization and training of young male toddlers to urinate while standing in an upright position.

BACKGROUND OF THE INVENTION

There have been a number of devices that have been used to train male toddlers to urinate while in the standing position. These have often been bulky and difficult to use, and expensive to manufacture. It is important that a urinal used for the training of toddlers be portable so that it can be used in a room where there is no plumbing such as a bedroom, nursery or play room where the toddler will feel that he is in comfortable surroundings. While there have been various urinals of this type, they have not been simple in design while being lightweight and portable. They have often required plumbing or been bulky and difficult to use. Examples of urinals of the type in question are illustrated in U.S. Pat. No. 5,010,599, entitled "Portable Unisex Urinal," U.S. Pat. No. 5,388,279, entitled "Toddler Urinal," and U.S. Pat. No. 5,044,020, entitled "Urinal for Convenience and Training of Juvenile Males."

SUMMARY OF THE INVENTION

In accordance with the present invention, there is provided a portable urinal which is light in weight, easy to use, and can be carried from room to room whenever desired. In addition, it is important that it be easy to keep clean and to permit ready removal of liquid waste.

Applicant's novel construction consists of a generally curved frame structure having a back wall and sidewalls with a large opening in front where the toddler would position himself while urinating. The urinal contains a sloped drain plate leading to a centrally disposed a drain in the bottom of the urinal, which drain empties into a drawer that can be readily pulled out and emptied. Needles to say, it is desirable to flush the urinal after every use and the flushing container is conveniently made a part of the upper portion of the urinal.

In order to flush the urinal, the water-filled container is supported by the upper walls of the urinal. The water tank can be readily placed in the urinal and removed therefrom to provide the flushing medium, and after it is used can be taken to where it can be refilled.

The bottom part of the flush tank contains holes that are spaced around the sides and rear of the tank adjacent the walls of the urinal so that when they are open the water in the tank will flow down the sidewalls and over the drain plate into the drain to rinse them off. The holes in the tank are normally sealed by a gasket member which insures that the water loaded into the tank will remain within the tank until flushing is desired. The gasket also contains holes, which holes are normally out of alignment with the tank holes. The gasket is operated by a handle pivotally secured to the frame and connected to the gasket to place the gasket holes into communication with the holes in the tank resulting in the water leaving the tank and flushing the sidewalls and the drain pan into the drain and urine collecting drawer. The urinal can be emptied by merely pulling out the drawer and taking it to a toilet where any urine located therein can be disposed of, after which the drawer will be rinsed out and returned to the urinal.

Another arrangement would be to separate the water chamber into upper and lower sections, with the upper chamber containing a single central opening and the lower chamber including a plurality of openings. The upper chamber would contain a plug over the central opening when filled with water. By merely pulling the plug, the water would empty into the lower chamber and flow out to flush the urinal. When it is to be refilled, the plug would be reinserted and water introduced to await a subsequent flushing.

The urinal is portable in nature, but if desired it can be connected to a wall by a suitable connecting means located at the back of the urinal which connections can include a gluing section, or other brackets or fasteners to connect the urinal to a wall section.

BRIEF DESCRIPTION OF THE DRAWINGS

The various features of the urinal will be appreciated from the following drawings, in which.

DESCRIPTION OF A PREFERRED EMBODIMENT

Figure 1:
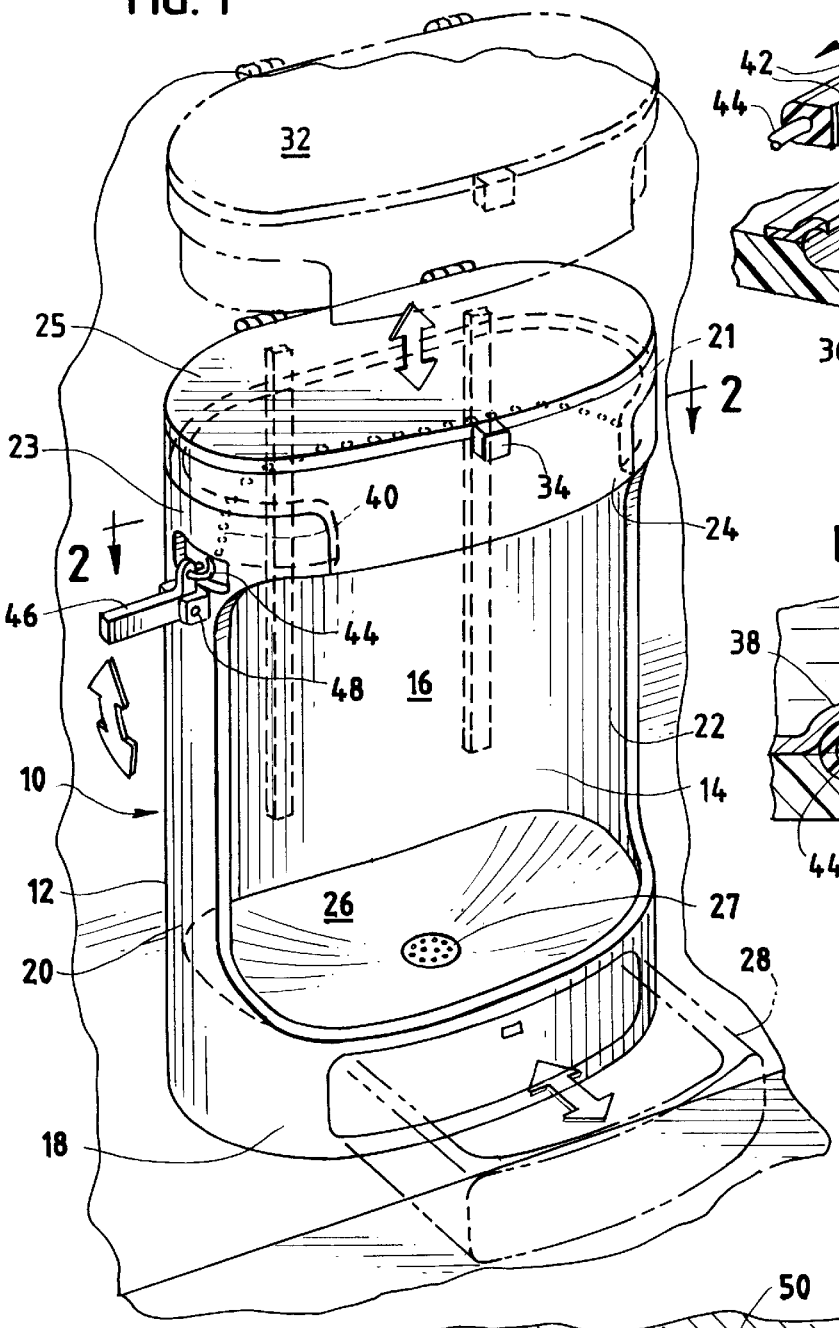
FIG. 1 is a perspective view of the urinal showing the tank and drawer both in the inserted and removed positions.

Referring now to FIG. 1, there is illustrated the portable male toddler urinal 10 which consists of a main frame structure 12 having an enlarged front central opening 14 through which the toddler is directed to urinate. The main frame 12 consists of a curved back wall 16, a front wall 18, and sidewalls 20, 22. The upper portions 21, 23 of the sidewalls 20, 22, respectively, extend slightly outward from the sidewalls 20, 22 to form a ledge 24 to receive the flush tank 25 to be inserted thereon. In this way, the tank will be retained relative to the frame walls.

When a toddler urinates through the opening 14, the urine will normally hit the back wall 16 and flow down to the drain plate 26 or be directed onto the drain plate 26 which is sloped toward the center so that the urine flows into the center drain 27. The urine flowing through the center drain 27 flows into the drawer 28, which drawer can be readily removed for emptying the urine and cleaning same prior to reinsertion into the urinal frame.

Any urine that remains on the walls or the drain plate 26 is flushed into the drain 27 by water from the flush tank 25 having a hinged lid 32 that as aforementioned is supported on the ledge 24 in the upper section of the urinal frame 12. The tank 25 can be readily removed from the walls and taken to a faucet where it is filled and then returned to its position on the ledge as shown in FIG. 1. The hinge lid 32 can be locked in position as schematically shown at 34 to prevent the toddler from inadvertently opening it up and emptying the water therefrom.

Figure 3:
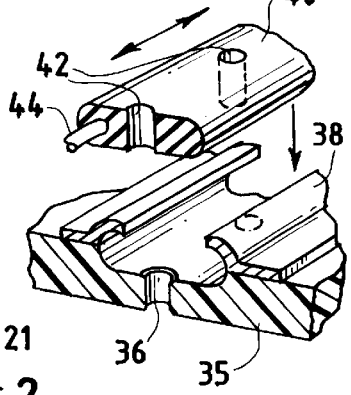
FIG. 3 is a broken away partial perspective view showing a portion of the gasket and bottom wall of the container in an exploded position.
Figure 4:
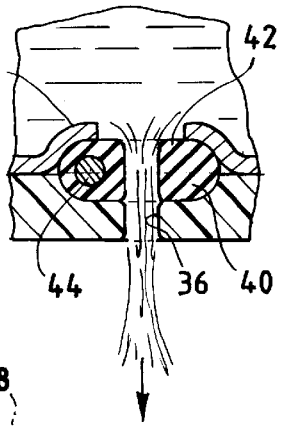
FIG. 4 is a partial sectional view showing the gasket and flushing tank holes in alignment whereby water is flowing therethrough to flush the urinal.
Figure 2:
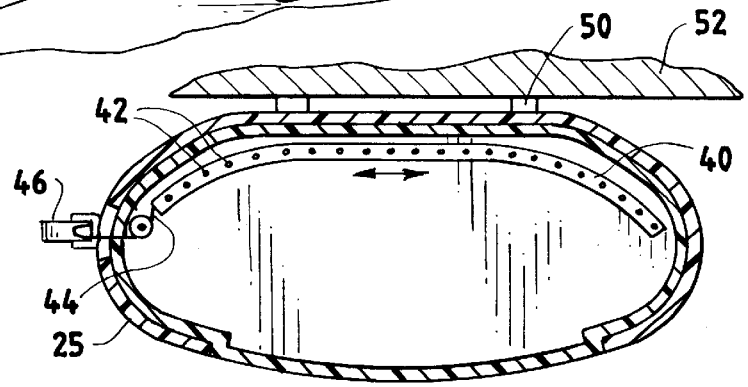
FIG. 2 is a section taken along line 2—2 of FIG. 1.

In order to retain the water in the flush tank, but enable it to be released and used for flushing the urinal, reference is made to FIG. 3 which shows a section of the bottom wall 35 of the flush tank which contains openings 36. Surrounding the row of openings 36 is a track 38 that is secured to the bottom wall 35 in which an elongated curved gasket seal 40 slides. The gasket seal 40 contains openings 42 that when located in alignment with the holes 36 in the drain tank bottom wall permits water to drain out of the tank 25 down the back and sidewalls onto the drain slate 26 into the center drain 27. The sealing gasket 40 moves with a sliding motion in the track 38 and is moved relative thereto by a gasket pull member 44. It can be appreciated when the gasket pull member is moved to align the openings 36, 42, the water will flow out to rinse the walls and drain plate. When the tank is to be refilled, the gasket is repositioned to misalign the openings so that water flowing into the tank will remain therein.

To readily facilitate the draining action, there is provided a handle 46 that is pivoted to the sidewall 20 by the pivot pin 48 and when the handle is pulled downwardly the gasket pull cord 44 moves the gasket 40 to align the holes and permit the flush water to flush the urinal.

It remains to note that in the illustrated embodiment, the urinal includes wall brackets 50 that can be connected to a wall 52 by glue or other suitable fastening means.

It is intended to cover by the appended claims all such modifications that fall within the true spirit and scope of the invention.

What is claimed is:

1. A portable urinal containing a frame structure which is generally elliptical in shape, and including walls defining a front opening and a ledge at its upper end, a drain plate supported by the frame structure adjacent the bottom thereof, a receptacle into which urine is collected, the drain plate defining a drain opening which leads into the receptacle, a flush tank assembly disposed on the top of the frame structure and supported by the ledge of the frame structure, the flush tank assembly including a bottom wall defining a plurality of holes adjacent the frame structure, the flush tank assembly including a flow control means comprising a gasket assembly, and means for operating the flow control means comprising a handle member secured to the frame structure and to the gasket assembly, which handle member controls the position of the gasket assembly, which in turns controls the flow of water from the flush tank assembly through the holes into the urinal to flush the urine deposited on the walls and drain plate of the urinal.

2. A urinal as set forth in claim 1 in which the bottom wall of the flush tank assembly includes a track defining holes and the gasket assembly also defines holes whereby when the gasket assembly holes and the flush tank assembly holes are in alignment the water will flow from said flush tank assembly.

3. A portable urinal containing a frame structure having walls defining a front opening, a drain plate supported by the frame structure adjacent the bottom thereof, a receptacle into which the urine is collected, the drain plate defining a drain opening which leads into the receptacle, a flush tank disposed on the top of the frame structure having a bottom wall with a plurality of holes therein, flow control means disposed adjacent said bottom wall and comprising a plurality of holes normally out of alignment with the bottom wall holes for sealing the flush tank, and means for operating the flow control means to align the holes therein with the bottom wall holes for emptying the flush tank to flush the urine deposited on the walls and drain plate of the urinal.

4. A urinal as set forth in claim 3 in which the frame structure is generally elliptical in shape and defines a ledge at its upper end for supporting the flush tank.

5. A urinal as set forth in claim 4 in which the receptacle collecting the urine consists of a drawer that is slidably mounted relative to the frame structure so that it can be removed and cleaned.

* * * * *